US011339937B2

(12) United States Patent
Chai

(10) Patent No.: US 11,339,937 B2
(45) Date of Patent: May 24, 2022

(54) MOTOR VEHICLE ILLUMINATING HEADLIGHT

(71) Applicant: Foshan Sunway Auto Electrical Co., Ltd, Foshan (CN)

(72) Inventor: Xueqian Chai, Foshan (CN)

(73) Assignee: Foshan Sunway Auto Electrical Co., Ltd

( * ) Notice: Subject to any disclaimer, the term of this patent is extended or adjusted under 35 U.S.C. 154(b) by 0 days.

(21) Appl. No.: 17/389,927

(22) Filed: Jul. 30, 2021

(65) Prior Publication Data

US 2022/0057061 A1 Feb. 24, 2022

(30) Foreign Application Priority Data

Aug. 24, 2020 (CN) ..... 202021787410.2

(51) Int. Cl.

| | |
|---|---|
| ***F21S 41/141*** | (2018.01) |
| ***F21S 41/29*** | (2018.01) |
| ***F21S 41/39*** | (2018.01) |
| ***F21V 23/00*** | (2015.01) |
| ***F21Y 115/10*** | (2016.01) |

(52) U.S. Cl.

CPC ..... *F21S 41/141* (2018.01); *F21S 41/295* (2018.01); *F21S 41/39* (2018.01); *F21V 23/003* (2013.01); *F21Y 2115/10* (2016.08)

(58) Field of Classification Search

CPC .. F21S 41/141–08; F21S 41/295; F21S 41/39; F21V 23/003

See application file for complete search history.

(56) References Cited

FOREIGN PATENT DOCUMENTS

WO WO-2014083123 A1 * 6/2014 ..... F21S 41/192

* cited by examiner

*Primary Examiner* — Britt D Hanley

(74) *Attorney, Agent, or Firm* — Barclay Damon LLP

(57) ABSTRACT

The present disclosure relates to a novel motor vehicle illuminating headlight. The motor vehicle illuminating headlight includes a power supply driver electrically connected with structure modules. The surfaces of the structure modules are in contact with an aluminum pressing strip, the aluminum pressing strip being connected with a radiator fixedly connected with the power supply driver, the outer side of the radiator being connected with a PC lens, and the other side of the radiator connected with a support. Advantageously, the illuminating use efficiency is improved, the application range is wide, automatic switching between a main illuminating light and atmosphere lights is achieved, and therefore better illumination is provided, energy conservation and environmental protection are facilitated, and the motor vehicle illuminating headlight has good ornamental and economic value.

5 Claims, 2 Drawing Sheets

MOTOR VEHICLE ILLUMINATING HEADLIGHT

CROSS REFERENCE TO RELATED APPLICATION(S)

This patent application claims the benefit and priority of Chinese Patent Application No. 202021787410.2, filed on Aug. 24, 2020, the disclosure of which is incorporated by reference herein in its entirety as part of the present application.

TECHNICAL FIELD

The present disclosure relates to the technical field of illumination, and specifically relates to a novel motor vehicle illuminating headlight.

BACKGROUND ART

Illumination is a measure of illuminating work and life places or individual objects with various light sources. Illumination by utilizing the sun and sky light is called "natural illumination"; and illumination by utilizing artificial light sources is called "artificial illumination". The primary purpose of illumination is to create good visibility and a comfortable and pleasant environment.

Motor vehicles are important means of transportation for daily travel of people, and when people drive at night, natural illumination is insufficient. Accordingly, illuminating head lights are selected to be additionally arranged on the motor vehicle to improve the illumination brightness of the motor vehicle during the design of the vehicle, so that driving safety is guaranteed. Existing motor vehicle illuminating headlights are single in structure function and effect, and cannot automatically switch from illuminating lights to atmosphere lights. Accordingly and due to this limitation, the use efficiency is reduced, perception and identification cannot be achieved between pedestrians and vehicles and between vehicles, and traffic accidents are caused.

SUMMARY

The present disclosure aims to provide a novel motor vehicle illuminating headlight so as to solve the problem proposed in the background art.

To achieve the above purpose, the present disclosure adopts the following technical scheme:

A novel motor vehicle illuminating headlight comprises a power supply driver, the power supply driver is electrically connected with a plurality of structure modules, the surfaces of the structure modules are in contact with an aluminum pressing strip, the aluminum pressing strip is connected with a radiator fixedly connected with the power supply driver, the outer side of the radiator is connected with a PC lens, and the other side of the radiator is connected with a support.

As a further scheme of the present disclosure, the structure modules comprise an LED aluminum substrate in contact with the aluminum pressing strip, the surface of the LED aluminum substrate is connected with a light guide element, a through hole is formed in the light guide element, a main illuminating LED light source fixedly connected with the LED aluminum substrate is arranged in the through hole, a plurality of secondary illuminating LED light sources fixedly connected with the LED aluminum substrate are uniformly distributed on the outer side of the light guide element, the main illuminating LED light source and the secondary illuminating LED light sources are electrically connected with the power supply driver, and a reflector connected with the LED aluminum substrate is arranged on the left side of the light guide element.

As the further scheme of the present disclosure, the secondary illuminating LED light sources and the light guide element are located on the same horizontal plane.

As the further scheme of the present disclosure, the reflector, the light guide element and the secondary illuminating LED light sources are integrally designed.

As the further scheme of the present disclosure, the support is rotationally installed on an automobile frame by taking 180 degrees as a limited angle.

Compared with the prior art, the novel motor vehicle illuminating headlight provided by the present disclosure has the following beneficial results in which the illuminating use efficiency is improved, the application range is wide, automatic switching between a main illuminating light and atmosphere lights is achieved, and therefore better illumination is provided. In addition, energy conservation and environmental protection are facilitated, and the novel motor vehicle illuminating headlight has good ornamental value and economic value. Still further, better perception and identification can be achieved between pedestrians and vehicles and between vehicles, so that traffic accidents are reduced.

Reference signs in drawings: 1, reflector; 2, LED aluminum substrate; 3, light guide element; 4, main illuminating LED light source; 5, secondary illuminating LED light source; 6, power supply driver; 7, radiator; 8, aluminum pressing strip; 9, PC lens; 10, support; and 11, structure module.

DETAILED DESCRIPTION OF THE EMBODIMENTS

The technical scheme of the present disclosure is further described in detail below with reference to the detailed description.

Embodiments of the present patent are described in detail below, and examples of the embodiments are illustrated in the attached figures, wherein same or similar reference numbers refer to the same or similar elements or elements with the same or similar function throughout. The embodiments described below by reference to the attached figures are exemplary only for explaining the present disclosure and are not to be construed as limiting the present disclosure.

Embodiment I

Figure 1:
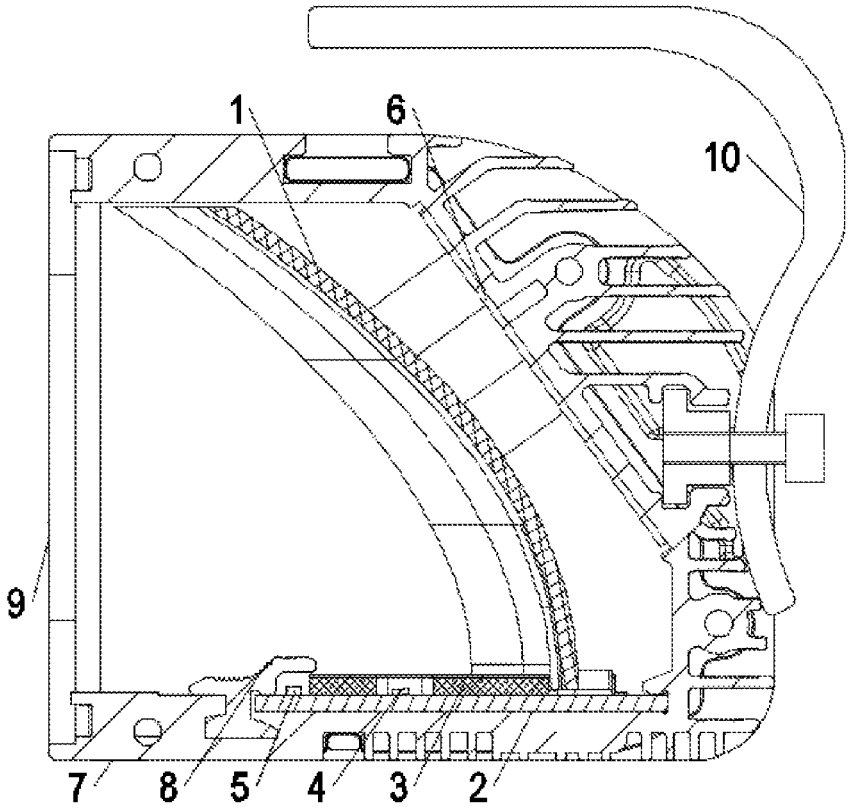
FIG. 1 is a structural schematic diagram of a novel motor vehicle illuminating headlight.
Figure 2:
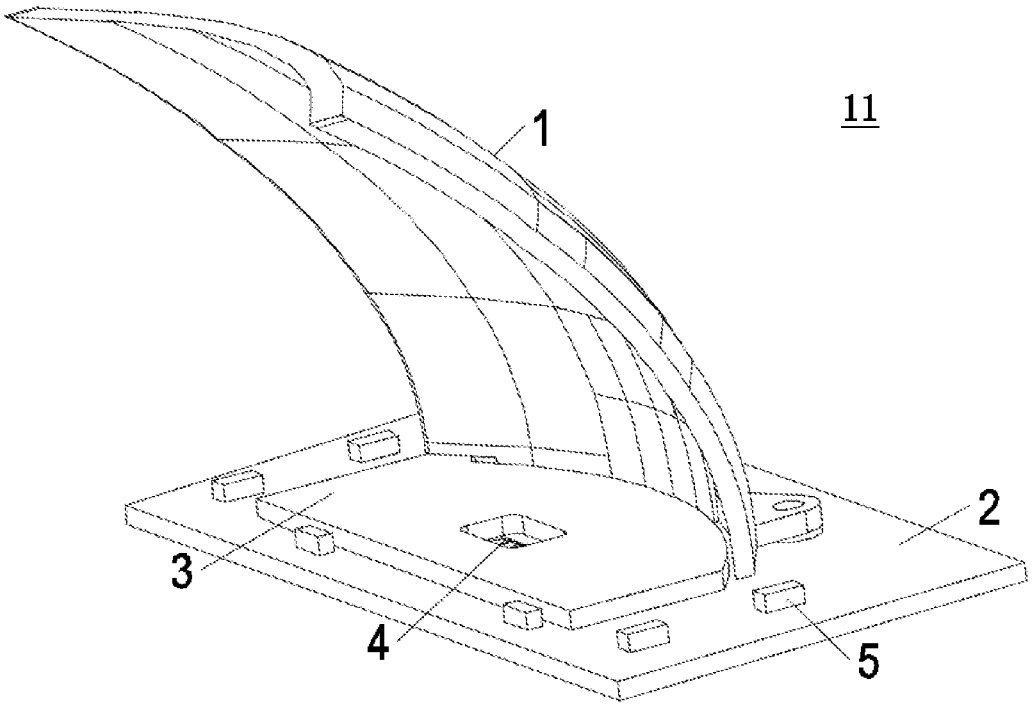
FIG. 2 is a structural schematic diagram of structure modules in the novel motor vehicle illuminating headlight.

Referring to FIG. 1 to FIG. 2, in the embodiment of the present disclosure, a novel motor vehicle illuminating headlight comprises a power supply driver 6, in which the power supply driver 6 is electrically connected with a plurality of structure modules 11 (one shown). The surfaces of each of the structure modules 11 are in contact with an aluminum pressing strip 8, with the aluminum pressing strip 8 being connected with a radiator 7 fixedly connected with the power supply driver 6. The outer side of the radiator 7 is connected with a PC lens 9, and the other side of the radiator 7 is connected with a support 10.

In the embodiment of the present disclosure, required color coordinate light colors are represented and filled through the structure modules 11, so that the motor vehicle illuminating headlight has the function of atmosphere lights. The structure modules 11 can also realize the function of position lights or daytime running lights, and the number of the structure modules 11 can be selected according to the requirements of customers for single-structure module or multi-structure module design. The structure modules 11 are controlled and adjusted through the power supply driver 6, wherein switching between a main illuminating light and the atmosphere lights (or position lights or daytime running lights) is achieved. Each of the structure modules 11 are fixed to the radiator 7 through the aluminum pressing strip 8, the power supply driver 6 is fixed through the radiator 7, the outer side of the radiator 7 is connected with the PC lens 9, and a light source penetrates through the PC lens 9 to achieve the illuminating purpose, with the motor vehicle illuminating headlight being fixed on an automobile frame through the support 10.

Embodiment II

Referring to FIG. 1 to FIG. 2, in the embodiment of the present disclosure, the structure modules 11 each comprise an LED aluminum substrate 2 in contact with the aluminum pressing strip 8, in which the surface of the LED aluminum substrate 2 is connected with a light guide element 3. According to this embodiment, a through hole is formed in the light guide element 3, in which a main illuminating LED light source 4 fixedly connected with the LED aluminum substrate 2 is arranged in the through hole. A plurality of secondary illuminating LED light sources 5 fixedly connected with the LED aluminum substrate 2 are uniformly distributed on the outer side of the light guide element 3, wherein the main illuminating LED light source 4 and the secondary illuminating LED light sources 5 are electrically connected with the power supply driver 6. A reflector 1 connected with the LED aluminum substrate 2 is arranged on the left side of the light guide element 3.

In the embodiment of the present disclosure, the power supply driver 6 drives the secondary illuminating LED light sources 5 to be energized, and light generated by the lightened secondary illuminating LED light sources 5 is refracted and reflected by the light guide element 3. This light is then uniformly emitted from the surface of the light guide element 3, and then is uniformly emitted after being reflected by the reflector 1, so that the reflector 1 presents the color of the colored light of the secondary illuminating LED light sources 5. The whole headlight reflector 1 presents and is filled with required color coordinate light colors; by means of the light guide mode, driving lights have the function of atmosphere lights (or position lights or daytime running lights), then the illumination intensity of the main illuminating LED light source 4 is controlled and adjusted through the power supply driver 6, function switching between the main illuminating light and the atmosphere lights (or the position lights or the daytime running lights) is achieved. According to this embodiment, the reflector 1 is a reflective mirror, the number of the secondary illuminating LED light sources 5 is selected according to the requirements of customers, with the secondary illuminating LED light sources 5 being suitably arranged on the side surface, the bottom surface or the inner cavity of the light guide element 3 according to the requirements of the customers, and in which the through hole can be rectangular, circular or trapezoidal.

Embodiment III

Referring to FIG. 1 to FIG. 2, in the embodiment of the present disclosure, the secondary illuminating LED light sources 5 and the light guide element 3 are located on the same horizontal plane.

In the embodiment of the present disclosure, optical surfaces of the secondary illuminating LED light sources 5 and the light guide element 3 are arranged on the same horizontal plane, so that the side surface of the light guide element 3 is aligned with the optical surfaces of the secondary illuminating LED light source 5. The light irradiated by the secondary illuminating LED light sources 5 can be uniformly emitted, and the ornamental value and the economic value are favorably improved.

Embodiment IV

Referring to FIG. 1 to FIG. 2, in the embodiment of the present disclosure, the reflector 1, the light guide element 3 and the secondary illuminating LED light sources 5 are integrally designed.

In the embodiment of the present disclosure, the reflector 1, the light guide element 3 and the secondary illuminating LED light sources 5 are integrally designed, so that production and processing are facilitated, the enterprise cost is reduced, and the economic benefit is brought for enterprises.

Embodiment V

Referring to FIG. 1, in the embodiment of the present disclosure, the support 10 is rotationally installed on an automobile frame by taking 180 degrees as a limited angle.

In the embodiment of the present disclosure, the support 10 is rotated and adjusted, so that the positions of the main illuminating LED light source 4 and the secondary illuminating LED light sources 5 are adjusted, and different illumination intensities are achieved, so that the requirements of motor vehicles on the illumination intensity under different conditions are met.

The foregoing descriptions are merely example implementations of the present disclosure. It should be noted that those skilled in the art may make several transformation or improvements without departing from the principle of the present disclosure, and the transformation or improvements shall fall within the protection scope of the present disclosure, but cannot influence the effect of the implementations of the present disclosure and the practicability of the present disclosure.

What is claimed is:

1. A motor vehicle illuminating headlight, comprising:

a power supply driver, a plurality of structure modules, each electrically connected with the power supply driver, an aluminum pressing strip in contact with surfaces of the plurality of structure modules, a radiator fixedly connected with the power supply driver and connected to the aluminum pressing strip, the radiator having an outer side connected with a PC lens and another side of the radiator being connected with a support, wherein each of the plurality of structure modules comprises an LED aluminum substrate in contact with the aluminum pressing strip, wherein a surface of the LED aluminum substrate is connected with a light guide element, the light guide element having a formed through hole.

2. The motor vehicle illuminating headlight according to claim 1, wherein the plurality of structure modules each comprise:

a main illuminating LED light source fixedly connected with the LED aluminum substrate and arranged in the through hole, the main illuminating LED light source being electrically connected with the power supply driver, a plurality of secondary illuminating LED light sources fixedly connected with the LED aluminum substrate and uniformly distributed on an outer side of the light guide element, wherein the main illuminating LED light source and the secondary illuminating LED light sources are electrically connected with the power supply driver, and a reflector connected with the LED aluminum substrate and arranged on one side of the light guide element.

3. The motor vehicle illuminating headlight according to claim 2, wherein the secondary illuminating LED light sources and the light guide element are located on the same horizontal plane.

4. The motor vehicle illuminating headlight according to claim 3, wherein the reflector, the light guide element and the secondary illuminating LED light sources are integrally designed.

5. The motor vehicle illuminating headlight according to claim 4, wherein the support is rotationally installed on an automobile frame by taking 180 degrees as a limited angle.

* * * * *